US005516327A

United States Patent [19]

Kawasaki

[11] Patent Number: 5,516,327

[45] Date of Patent: May 14, 1996

[54] POLISHING METHOD, DEVICE AND BUFF WHEEL THEREFOR

[75] Inventor: Shuji Kawasaki, Hamamatsu, Japan

[73] Assignees: Asahi Tec. Corporation; BBF Yamate Corporation, both of Shizuoka, Japan

[21] Appl. No.: 275,824

[22] Filed: Jun. 30, 1994

[30] Foreign Application Priority Data

| | | | |
|---|---|---|---|
| Oct. 30, 1992 | [JP] | Japan | 4-315643 |
| Oct. 30, 1992 | [JP] | Japan | 4-315644 |
| Dec. 31, 1992 | [JP] | Japan | 4-359980 |
| Dec. 31, 1992 | [JP] | Japan | 4-359981 |
| Aug. 5, 1993 | [JP] | Japan | 5-215179 |

[51] Int. Cl.[6] ..... B24B 7/19; B24B 7/30

[52] U.S. Cl. ..... 451/60; 451/285; 451/288

[58] Field of Search ..... 451/270, 283, 451/285–288, 36, 53, 54, 57, 59, 60, 268, 269, 41, 42

[56] References Cited

U.S. PATENT DOCUMENTS

| | | | |
|---|---|---|---|
| 3,568,371 | 3/1969 | Day et al. | 451/286 |
| 3,631,634 | 1/1972 | Weber | 451/288 |
| 4,143,489 | 3/1979 | Sogner | 451/135 |
| 4,268,999 | 5/1981 | Noto et al. | 451/6 |
| 4,450,652 | 5/1984 | Walsh | 451/288 |
| 4,512,859 | 4/1985 | Inoue | 451/36 |
| 4,607,496 | 8/1986 | Nagaura | 451/288 |
| 4,951,420 | 8/1990 | Sorg | 451/163 |
| 5,203,121 | 4/1993 | Metzger | 451/53 |
| 5,216,843 | 6/1993 | Breivoget et al. | 451/285 |
| 5,291,694 | 3/1994 | Hosoya et al. | 451/54 |

*Primary Examiner*—Bruce M. Kisliuk
*Assistant Examiner*—Derris Banks
*Attorney, Agent, or Firm*—Darby & Darby

[57] ABSTRACT

In a polishing method for polishing a work (W) by a rotating buff wheel (12) while polishing agent (B) is supplied between the polishing surface (121) of the buff wheel (12) and the surface of the works (W) to be polished, the surface of the work (W) to be polished is polished while the polishing surface of the buff wheel (12) is moved back and forth relative to the surface of the work (W) to be polished.

31 Claims, 6 Drawing Sheets

POLISHING METHOD, DEVICE AND BUFF WHEEL THEREFOR

This is a continuation of international application Ser. No. PCT/JP93/01566, filed Oct. 29, 1993.

FIELD OF THE INVENTION

This invention relates to a polishing method using a buff wheel, a device and the buff wheel therefor.

BACKGROUND OF THE INVENTION

With conventional polishing devices using a buff wheel, surface of a work is polished by the buff wheel rotated by rotary drive means while polishing agent is supplied.

The conventional polishing device as described above, however, has a disadvantage; since the polishing surface of the buff wheel is not always in contact with the surface of the work to be polished, polishing agent cannot sufficiently enter the gap between the polishing surface of the buff wheel and the surface of the work to be polished, the work cannot be polished efficiently.

Moreover, since the conventional buff wheels are a single body, a suitable wheel has to be chosen according to the purpose of polishing, resulting in difficulty in improving the working efficiency.

Another disadvantage with the conventional polishing device is that since only one buff wheel is provided with the polishing device, the rotary directions of the buff wheel has to be changed because the work has to be polished in both normal and reverse rotary directions.

Furthermore, since the polishing surface of the buff wheel of the conventional polishing device is not constantly in contact with the surface of the work to be polished, polishing agent cannot sufficiently enter the gap between the polishing surface of tire buff wheel and the surface of the work to be polished, and polishing cannot be made uniform. As a result, polishing the surface of the work to be polished cannot be made efficiently.

Another disadvantage with the conventional polishing device is that since the polishing agent is merely supplied, function of the polishing agent is not effectively utilized.

The first object of the invention is to provide a method and device for efficiently polishing the surface of the work to be polished.

The second object of the invention is to provide a polishing device capable of polishing the surface of the work to be polished in both normal and reverse directions. The third object of the invention is to provide a polishing method and device capable of polishing the surface of the work to be polished easily to a uniform surface condition.

The fourth object of the invention is to provide a polishing method and device in which polishing agent can fully function.

The fifth object of the invention is to provide a buff wheel requiring no wheel replacement according to purposes of polishing.

DISCLOSURE OF THE INVENTION

To achieve the first object, the polishing method of this invention makes easy for the polishing agent enter the gap between the polishing surface of the buff wheel and the surface of the work to be polished; in the polishing method in which the work is polished by the polishing surface of the rotating buff wheel while the polishing agent is supplied between the gap, the polishing surface of the buff wheel is moved to and from the surface of the work to be polished.

To achieve the first object, the polishing device of this invention makes it easy to carry out the method of polishing described above; in the polishing device provided with rotary drive means and the buff wheel to rotate the buff wheel by the rotary drive means and polish the surface of the work to be polished by the polishing surface of the buff wheel, the polishing surface of the buff wheel is made capable of moving to and from the surface of the work to be polished.

To achieve the second object, the polishing device of this invention makes it possible to polish the surface of the work to be polished in opposite directions by two buff wheels while the work is rotated about the center of the surface of the work to be polished; in the polishing device provided with the buff wheels rotated by suitable means, with the work set for rotation about the center axis of the surface to be polished, to polish the surface by the bottom surface of the buff wheels, a pair of buff wheels are employed and rotated about their axes in opposite directions each other; or in the polishing device provided with the buff wheels rotated by suitable means, with the work set for rotation about the center axis of the surface to be polished, to polish the surface by the bottom surface of the buff wheels, a pair of buff wheels are employed and one buff wheel is rotated in the same direction with that of the rotation of the work and brought into contact with the surface to be polished, while the other buff wheel is rotated in the opposite direction and brought into contact with the surface to be polished.

To achieve the third object, the polishing method of this invention makes it easy for the polishing agent to smoothly enter the gap during the polishing process between the polishing surface of the buff wheel and the surface of the work to be polished and to polish the surface to be polished uniformly with a simple mechanism; in the polishing method in which the work is polished by the polishing surface of the rotating buff wheel while the polishing agent is supplied between the gap, the polishing is performed while the rotary axes of the buff wheels are oscillated or shaken along the surface of the work to be polished.

To achieve the third object, the polishing device of this invention makes it easy for the polishing agent to smoothly enter the gap during the polishing process between the polishing surface of the buff wheel and the surface of the work to be polished and to polish the surface to be polished uniformly with a simple mechanism; in the polishing device provided with the rotary drive means and buff wheels rotated by the rotary drive means to polish the surface of the work to be polished by the polishing surface of the buff wheels, rotary shafts of the buffs are made capable of oscillating along the surface of the work to be polished.

To achieve the fourth object, the polishing method of this invention makes it possible to effectively utilize the function of the polishing agent; in the polishing method in which the work is polished by the polishing surface of the rotating buff wheels while the polishing agent is supplied into the gap between the polishing surfaces of the buff wheels and the surface of the work to be polished, the polishing agent is heated while being supplied, or the work is heated before being polished.

To achieve the fourth object, the polishing device of this invention makes it possible to effectively utilize the function of the polishing agent; in the polishing device in which the work is polished by the polishing surface of the rotating buff wheels while the polishing agent is supplied into the gap between the polishing surfaces of the buff wheels and the surface of the work to be polished, a reservoir with heating means for the polishing agent is employed, or heating means for heating the work is employed.

To achieve the fifth object, the buff wheel of the invention comprises, an elastic disk body, a boss detachably fit into the center of the elastic disk body, and a polishing sheet detachably placed over the outer circumferential surface of the disk body, so that the elastic body and the polishing sheet may be chosen according to the purpose of the polishing.

THE BEST FORM OF EMBODYING THE INVENTION

The invention will be explained in detail taking a wet type polishing method as an embodiment in reference to the attached drawings.

Figure 1:
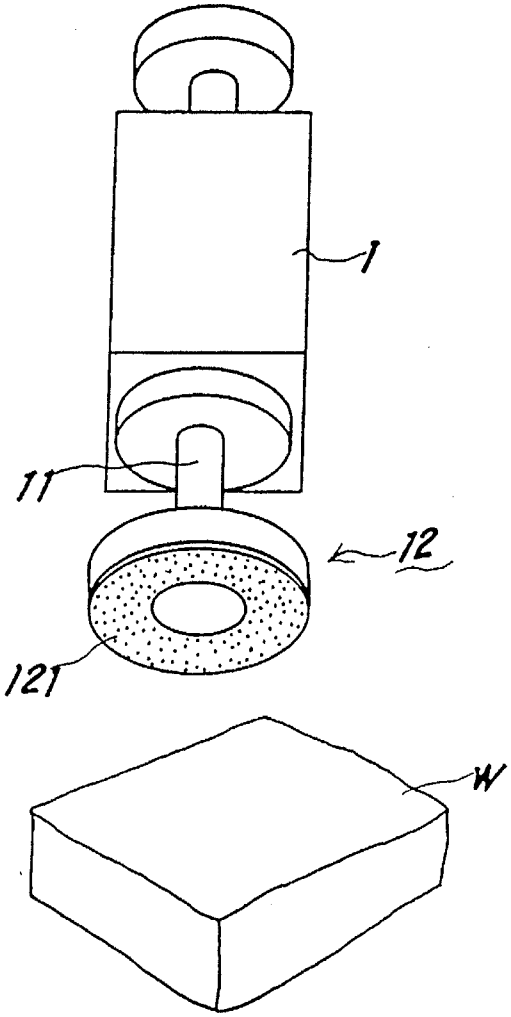
FIG. 1 is a perspective view of a polishing device of the invention.

In FIG. 1 are shown a rotary drive device 1 provided with a drive source such as an electric motor. A rotary shaft 11 is provided on the drive source 1 and rotated about its axis by the power of the motor or the like described above. The rotary shaft 11 is capable of moving in and out along its axial direction by suitable means. A buff wheel 12 is secured at the end of the rotary shaft 11. The buff wheel 12 is rotated to polish a work W by means of a polishing surface 121 located on its end side. If the rotary shaft 11 is moved in and out along its axial direction here, a gap is produced between the polishing surface 121 and the work W so that liquid polishing agent, powder polishing agent or paste polishing agent is easily made to enter the gap.

Figure 2:
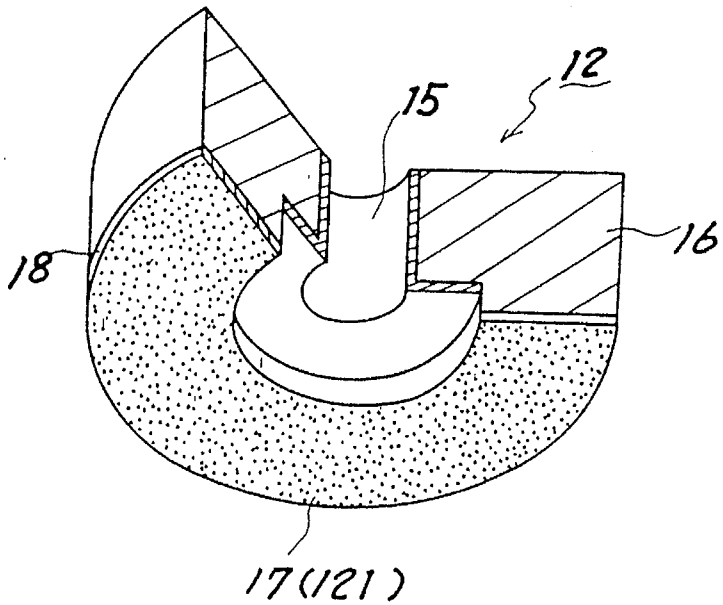
FIG. 2 is a perspective view of another embodiment.

In FIG. 2, a boss member 15 of the wheel 12 is made of aluminum and the wheel 12 is secured through the boss member 15 to the rotary shaft 11 of the rotary drive device 1. An elastic disk body 16 is detachably fitted over the boss member 15 and made of spongy material with its one side projecting beyond the boss member 15. A polishing sheet 17 is detachably secured by Velcro or the like through an auxiliary elastic body 18 to the projecting one side of the elastic disk body 16. The polishing sheet 17 is made of felt, flannel, leather, etc. and constitutes the polishing surface 121 for polishing the work W. By the way, the polishing sheet 17 will more easily conform to the surface of the work W to be polished if the resilience of the auxiliary elastic body 18 is made smaller than that of the elastic disk body 16. Furthermore, if the auxiliary elastic body 18 is secured to the polishing sheet 17 and arranged detachably on the elastic disk body 16, the auxiliary elastic body 18 may be suitably replaced.

Furthermore, if the auxiliary elastic body 18 is secured to the polishing sheet 17 and arranged detachably on the elastic disk body 16, the auxiliary elastic body 18 may be suitably replaced so that the elasticity of the buff wheel 12 itself is easily adjusted according to the purpose of the polishing.

Figure 3:
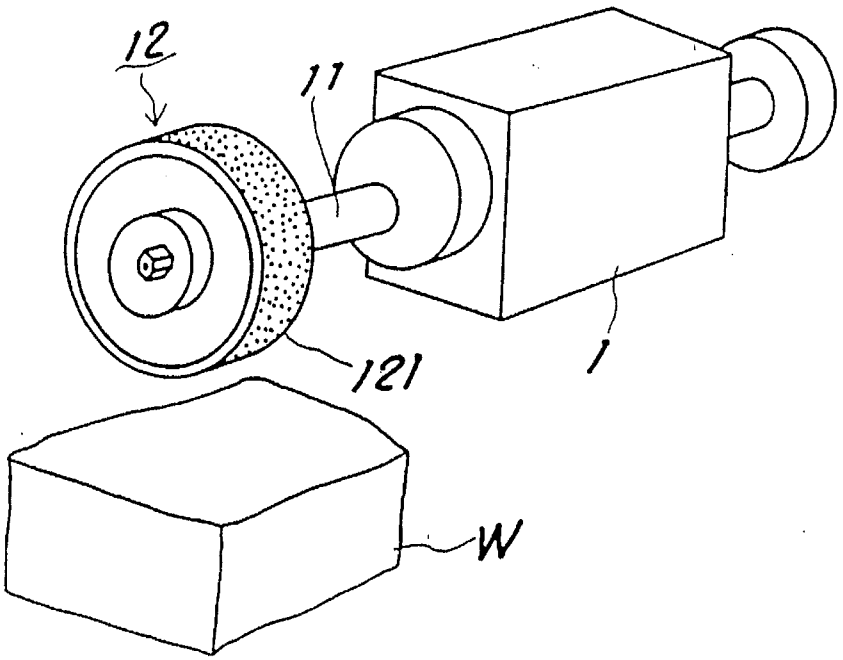
FIG. 3 is a perspective view of the polishing wheel partially in cross section.

FIG. 3 shows another embodiment in which the polishing surface 121 is provided on the circumference side of the buff wheel 12, and the axis of the rotary shaft 11 comes close to or apart from the work W by suitable means.

Figure 4:
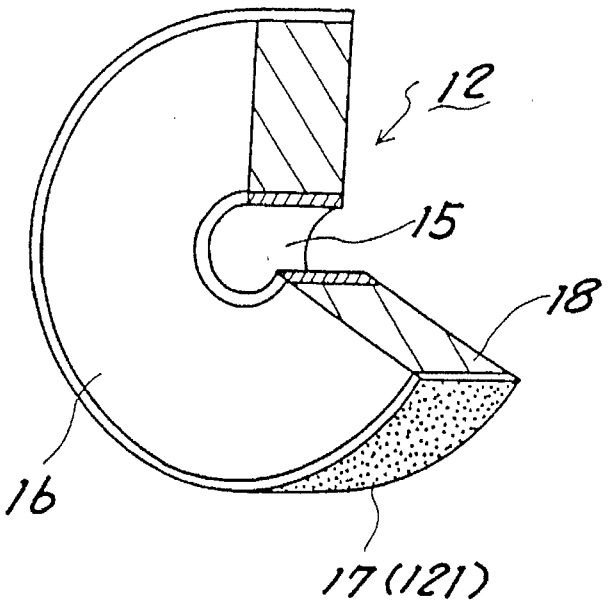
FIG. 4 is a perspective view of another embodiment of the polishing wheel partially in cross section.

The buff wheel 12 of this embodiment as shown in FIG. 4 is provided with the boss member 15 in the central area around which is arranged detachably the elastic disk body 16 around which is arranged detachably the polishing elastic sheet 17 through the auxiliary elastic body 18. The mutual relationships of the resilience values and materials between the elastic disk body 16 and the polishing elastic sheet 17 are similar to those of the previous embodiment.

Figure 5:
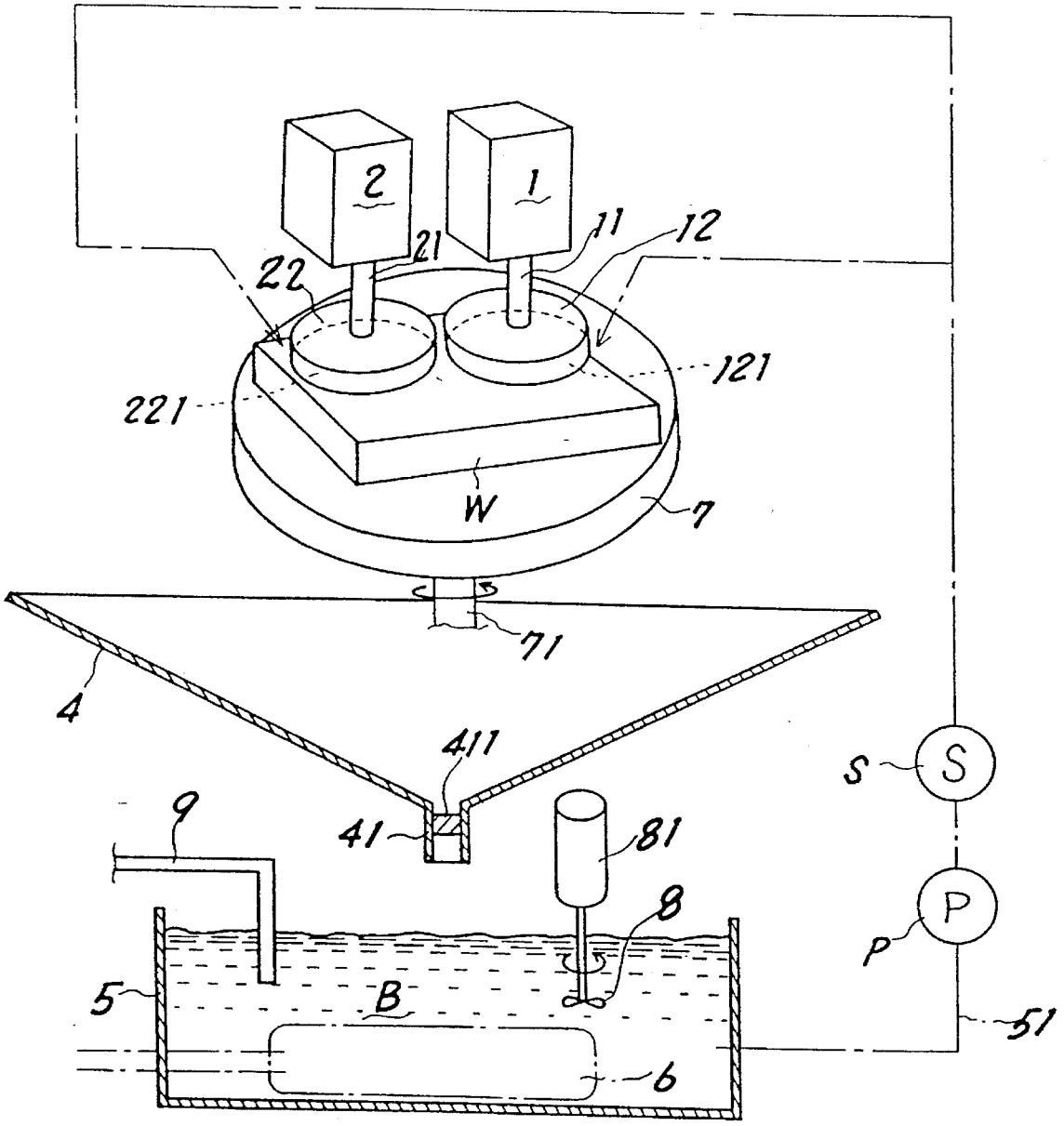
FIG. 5 is an explanatory drawing of another embodiment of the polishing device of the invention.

FIG. 5 shows another embodiment of the invention. In FIG. 5, the a support table 7 with a support shaft 71 provided on its axis is rotated in the direction of the arrow about the support shaft 71 by suitable means. The work W of a disk shape is placed on the support table 1. The upper surface of the work W is to be polished.

A first rotary drive device 1 is provided with a drive source such as an electric motor. The rotary shaft 11 is provided on the rotary drive device 1 and rotated about its axis by the power of the motor or the like. The first buff wheel 12 is secured to the end of the rotary shaft 11. The work W is polished by the polishing surface 121 which is the bottom surface of the buff wheel 12 being rotated.

A second rotary drive device 2 is similarly provided with a drive source such as an electric motor. The rotary shaft 21 is provided on the rotary drive device 2 and rotated about its axis by the power of the motor or the like. A second buff wheel 22 is secured to the end of the rotary shaft 21. The work W is polished by the polishing surface 221 which is the bottom surface of the buff wheel 22 being rotated.

Since the first and second buff wheels 12 and 22 are rotated in opposite directions each other, the surface of the work W to be polished is polished in directions opposite each other.

In FIG. 5, a pan 4 for the polishing agent is located under the support table 7 to collect the polishing agent (polishing liquid containing polished particles) discharged from the surface of the work W to be polished. A polishing agent discharge pipe 41 is provided on the polishing agent pan 4 to discharge the polishing agent (liquid) collected through a strainer 411 downward. Polished particles of larger sizes in the polishing agent (liquid) are removed while passing through the strainer 411.

A polishing agent reservoir 5 is located below the polishing agent pan 4 to hold the polishing agent (liquid) B so that the polishing agent (liquid) is discharged from the polishing agent pan 4 through the polishing agent discharge pipe 41. The polishing agent (liquid) B discharged into the reservoir 5 is supplied again by the function of a pump P through a flow passage 51 to the gap between the polishing surfaces 221, 321 of the buff wheels 22, 32 and the surface of the work W to be polished. In other words, the polishing agent (liquid) B is circulated through the flow passage 51 and others. A strainer 52 is provided in the flow passage 5 to remove dust of minute sizes.

An electric heater 6 is provided in the polishing agent reservoir 5 to heat the polishing agent (liquid) B. The polishing agent (liquid) B is preferably heated to 37° C. to 60° C. because if the temperature is below 37° C., convection is hard to occur in the polishing agent (liquid) B, and if above 60° C., the polishing agent is dried when it is blown to the surface of the work W to be polished and loses its function as polishing agent (liquid) B. The same is true with polishing agent (solid polishing agent) used in dry type polishing methods.

A stirring blade 8 driven by a motor 81 and an air bubble supply pipe 9 are provided in the polishing agent reservoir 5. The stirring blade 8 is rotated to stir the polishing agent (liquid) B while air bubbles supplied through the air bubble supply pipe 9 to the polishing agent (liquid) B assists the stirring of the polishing agent (liquid) B.

The reason for heating the polishing liquid B to 37° C. to 60° C. is to prevent the polishing agent from being dried when it is blown to the work W while maintaining convection in the polishing liquid B. Instead of heating the polishing liquid B, the work W may be heated, after it Is set in position, by blowing hot air to temperatures 37° C. to 60° C.

Figure 6:
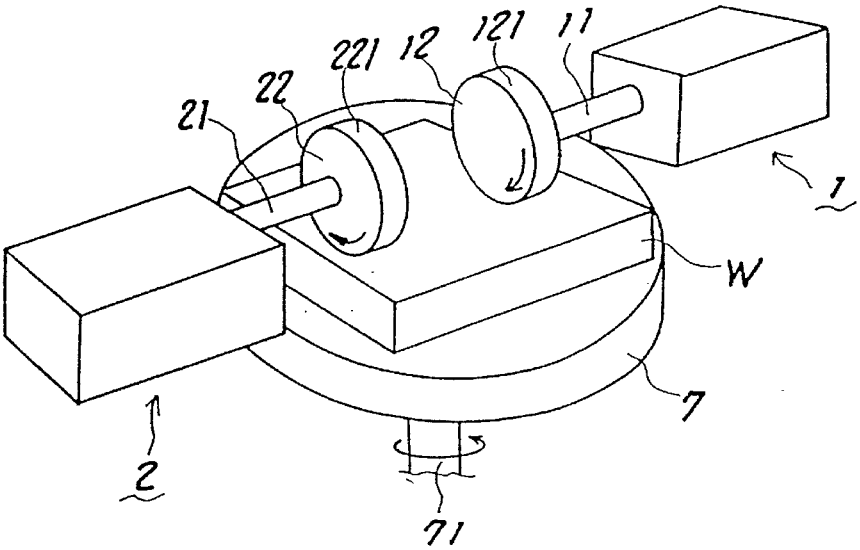
FIG. 6 is a perspective view of another embodiment of the polishing device of the invention.

FIG. 6 shows another embodiment in which the outer circumference of each of the buff wheels 12, 22 is used as the polishing surface. In this case, the first buff wheel 12 is rotated in the direction opposite the rotating direction of the work W and brought into contact with the surface of the work W to be polished, while the second buff wheel 22 is rotated in the direction same with the rotating direction of the work W and brought into contact with the surface of the work to be polished.

As a result, the surface of the work W to be polished is polished in directions opposite each other.

Figure 7:
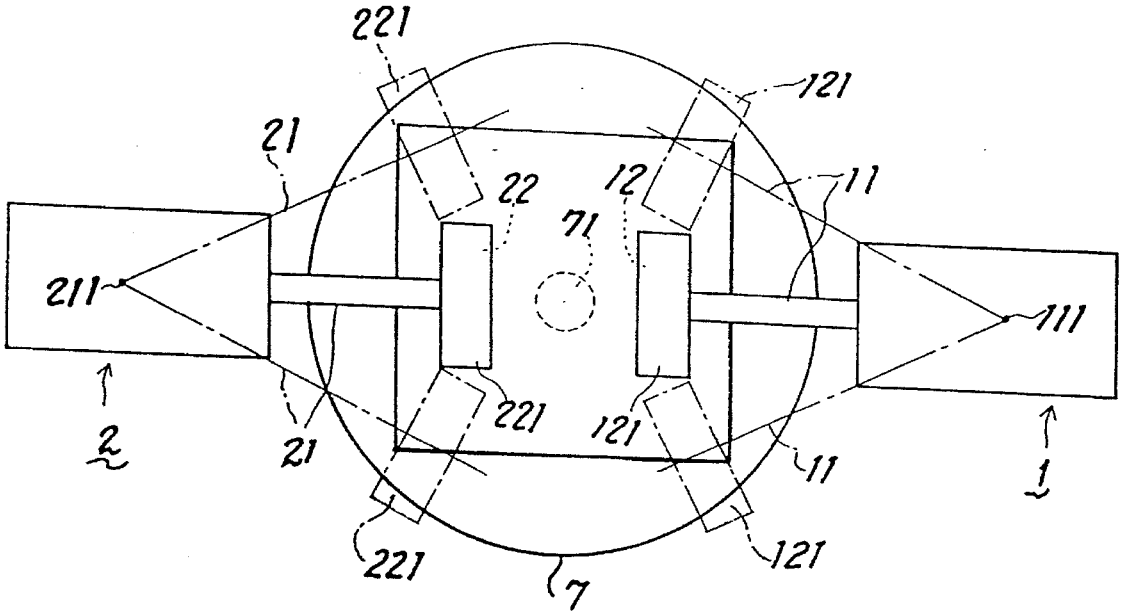
FIG. 7 is a plan view of another embodiment similar to that shown in FIG. 6.

FIG. 7 shows another embodiment as an improvement of the embodiment described above. In FIG. 7, the first rotary drive device 1 has its center of oscillation 111 at its approximate central portion. The first rotary drive device 1 is oscillated to both sides of the oscillation center 111 through suitable means (such as a crank mechanism, rack and pinion, etc.) in horizontal directions. The rotary shaft 11 is located on the oscillation center 111. By arranging the oscillation center of the rotary shaft 11 on the axis of the rotary shaft 11, such oscillation is made smooth. The rotary shaft 11 is rotated about its axis by the power of the motor or the like as described before. The first buff wheel 12 is secured to the end of the rotary shaft 11 to polish the work W by means of its outer circumferential polishing surface 121. When the first rotary drive device 1 is oscillated horizontally through suitable means (such as crank mechanism, rack and pinion mechanism, etc.), the buff wheel 12 is oscillated as shown with imaginary lines in FIG. 7.

Similarly to the first rotary drive means 1, the second rotary drive device 2 is provided with a drive source such as an electric motor. The oscillation center 211 is located in the approximate central portion of the second rotary drive device 2. The second rotary drive device 2 is oscillated to both sides of the oscillation center 211 through suitable means (such as a crank mechanism, rack and pinion, etc.) in horizontal directions. The rotary shaft 21 is located on the oscillation center 211. The rotary shaft 21 is rotated about its axis by the power of the motor or the like as described before. The second buff wheel 22 is secured to the end of the rotary shaft 21 to polish the work W by means of its outer circumferential polishing surface 221. When the first rotary drive device 2 is oscillated horizontally through suitable means (such as crank mechanism, rack and pinion mechanism, etc.), the buff wheel 22 is oscillated as shown with imaginary lines in FIG. 7. The second buff wheel 22 is rotated in the direction opposite the rotating direction of the first buff wheel 12. The oscillating direction of the second buff wheel 22 may be either the same as or opposite the oscillating direction of the first buff wheel 12.

Figure 8:
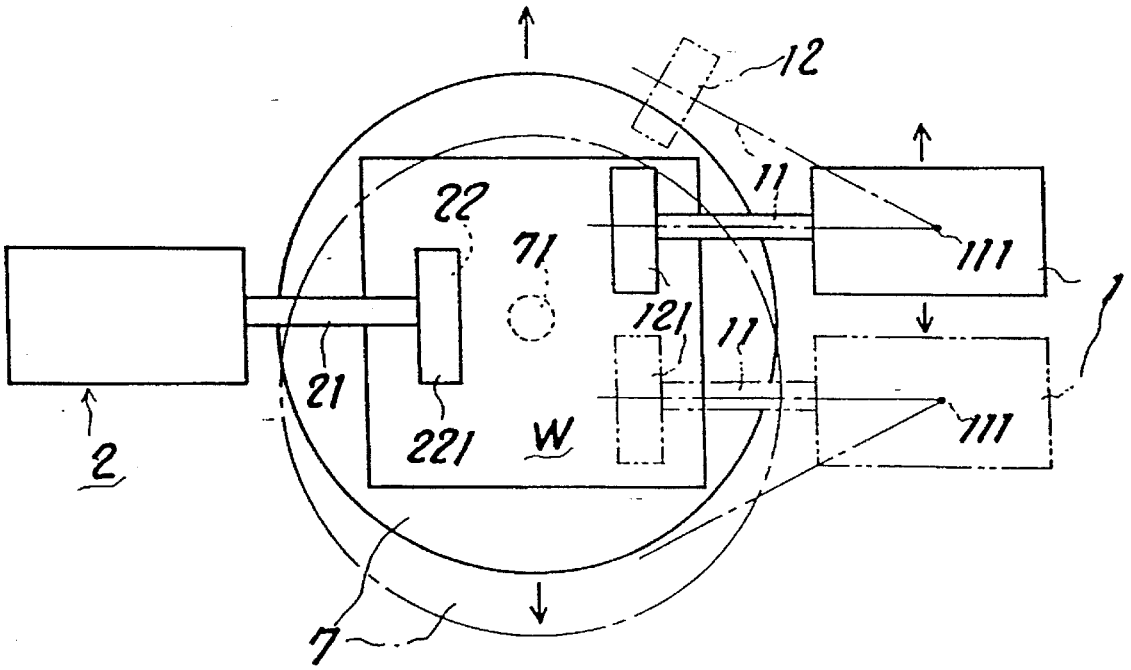
FIG. 8 is a plan view of another embodiment similar to that shown in FIG. 7.

FIG. 8 shows another improved embodiment based on the embodiment described above, in which the rotary shaft 11 together with the first rotary drive device i are arranged to be capable of reciprocating in the direction normal to its axis (Refer to the direction of the arrow) and the first buff wheel 12 is made capable of moving in the same direction. This reciprocating movement is performed generally parallel to the support table 7 or the work W (Refer to the dash-and-double-dotted line in FIG. 8). This arrangement makes it possible to polish the entire work uniformly.

Figure 9:
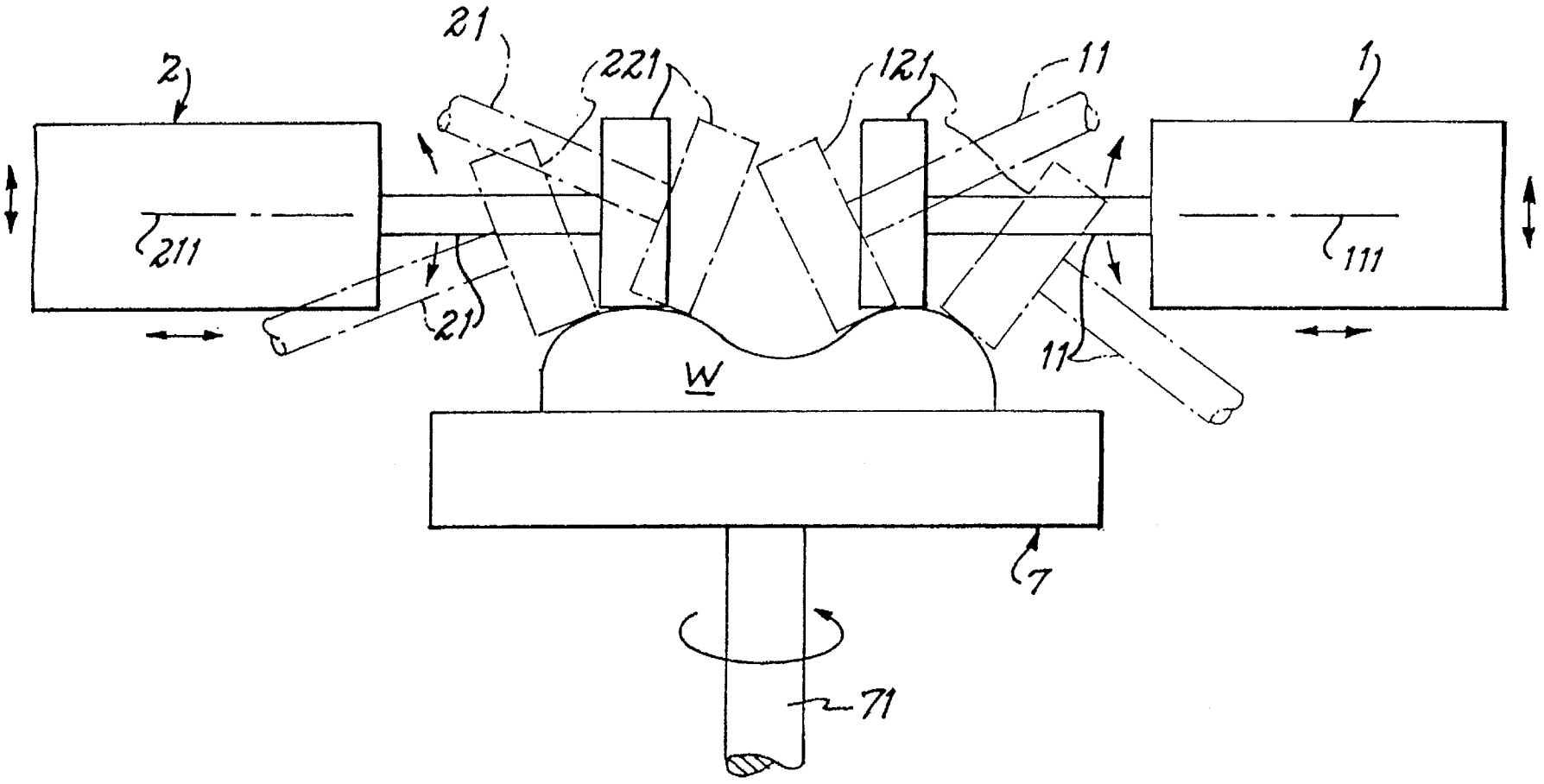
FIG. 9 is a plan view of a further embodiment similar to that shown in FIG. 8.

The second rotary drive device 2 may also be arranged, similarly to the first rotary drive device 1, to be capable of reciprocating. FIG. 9 shows another improved embodiment, in which the rotary shaft 11 together with the first rotary drive device 1 and the rotary shaft 21 together with the second rotary device 2 are arranged to be capable of oscillating along the vertical direction and moving in and out along the vertical direction and along the horizontal direction (refer to the direction of the arrows).

USEFULNESS OF THE INVENTION

As described above, the polishing method, device, and buff wheels therefor are useful as means for polishing the work while liquid polishing agent is supplied in the gap between the polishing surface of the rotating buff wheel and the surface of the work to be polished.

What is claimed:

1. A polishing method in which a work (W) is polished by a buff wheel (12) rotated by rotary drive means (1) while polishing agent (B) is supplied in a gap between the polishing surface (121) of the buff wheel (12) and the surface of the work (W) to be polished, characterized in that the polishing surface (121) of the buff wheel (12) is capable of reciprocating parallel to the surface of the work (W) to be polished while the polishing is performed.

2. The polishing method of claim 1, characterized in that the buff wheel (12) together with the rotary drive device (1) are made capable of reciprocating.

3. A polishing device comprising rotary drive means (1) and a buff wheel (12) for polishing a work (W) with a polishing surface (121) of the buff wheel (12) while the buff wheel (12) is rotated by the rotary drive means, characterized in that the polishing surface (121) of the buff wheel (12) is made capable of reciprocating parallel to the surface of the work (W) to be polished.

4. The polishing device of claim 3, characterized in that the device is further provided with a reservoir (5) for the polishing agent (B) and the reservoir (5) is provided with heating means for maintaining connection.

5. The polishing device of claim 3, characterized in that the buff wheel (12) together with the rotary drive device (1) are made capable of reciprocating.

6. A polishing device comprising a work (W) with a surface to be polished, and buff wheels (12) rotated by suitable means, for polishing the work (W) arranged to be capable of rotating about an axis in the center of the surface to be polished by the bottom surfaces of the buff wheels (12), characterized in that the buff wheels (12) are provided in a pair, and the buff wheels (12) are rotated respectively in opposite directions each other.

7. A polishing device comprising a work (W) with a surface to be polished, and buff wheels (12) rotated by suitable means, for polishing the work (W) arranged to be capable of rotating about an axis in the center of the surface to be polished by the outer circumferential surfaces of the buff wheels (12), (22), characterized in that the buff wheels (12), (22) are provided in a pair, one (12) of the buff wheels is rotated in the direction same with the rotating direction of the work (W) and brought into contact with the surface of the work (W) to be polished while the other one (22) of the buff wheels is rotated in the direction opposite the rotating direction of the work (W) and brought into contact with the surface of the work (W) to be polished.

8. A polishing method in which a work (W) is polished by rotating buff wheels (12), (22) while polishing agent (B) is supplied in gaps between the polishing surfaces of buff wheels (12), (22) and the surface of the work (W) to be polished, characterized in that the rotary shafts (11), (21) respectively of the buff wheels (12), (22) are oscillated along the surface of the work (W) to be polished while the polishing is performed.

9. The polishing method of claim 8, characterized in that the centers of oscillation of the rotary shafts (11), (21) are arranged on the axes of the rotary shafts (11), (21).

10. The polishing method of claim 8, characterized in that the rotary shafts (11), (21) are arranged capable of reciprocating in the direction normal to their axes.

11. A polishing device comprising rotary drive means (1), (2) and buff wheels (12), (22) for polishing the surface of the work (W) to be polished by the polishing surfaces of the buff wheels (12), (22) rotated by the rotary drive means (1), (2), characterized in that the rotary shafts (11), (21) of the buff wheels (12), (22) are made capable of oscillating along the surface of the work (W) to be polished.

12. The polishing device of claim 11, characterized in that the center of oscillation of the rotary shafts (11), (21) are arranged on the axes of the rotary shafts (11), (21).

13. The polishing device of claim 11, characterized in that the rotary shafts (11), (21) are arranged capable of reciprocating in the direction normal to the axes of the rotary shafts (11), (21) and the reciprocating movement is made generally parallel to the work (W).

14. The polishing device of claim 11, characterized in that the device comprises a reservoir (5) for the polishing agent (B) and the reservoir (5) is provided with heating means for maintaining connection.

15. A polishing method in which the work (W) is polished by rotating buff wheels (12), (22) while the polishing agent (B) is supplied in the gap between the polishing surfaces (121), (221) of the buff wheels (12), (22) and the surface of the work (W) to be polished, characterized in that the polishing agent (B) is heated to maintain convection.

16. A polishing method in which the work (W) is polished by rotating buff wheels (12), (22) while the polishing agent (B) is supplied in the gap between the polishing surfaces (121), (221) of tire buff wheels (12), (22) and the surface of the work (W) to be polished, characterized in that the work (W) is polished after the work (W) is heated.

17. The polishing method of claim 15, characterized in that the polishing agent (B) is heated to a temperature in the range of 37° C. to 60° C. maintain connection.

18. The polishing method of claim 15, characterized in that the work (W) Is heated to a temperature in the range of 37° C. to 60° C.

19. The polishing method of claim 18, characterized in that the work (W) is heated by hot air after the work is set in position.

20. A polishing device in which the work (W) is polished by rotating buff wheels (12), (22) while the polishing agent (B) is supplied in the gap between the polishing surfaces (121), (221) of the buff wheels (12), (22) and the surface of the work (W) to be polished, characterized in that the device comprises a reservoir (5) for the polishing agent (B) and the reservoir (5) is provided with heating means for maintaining connection.

21. A polishing device in which the work (W) is polished by rotating buff wheels (12), (22) while the polishing agent (B) is supplied in the gap between the polishing surfaces (121), (221) of the buff wheels (12), (22) and the surface of the work (W) to be polished, characterized in that the device is provided with means for heating the work (W).

22. A polishing buff wheel characterized in that a boss member (15) is detachably arranged in the axial center portion of an elastic disk body (16) and a detachable polishing sheet (17) is provided on the outer circumferential surface of the disk body (16).

23. The polishing buff wheel of claim 22, characterized in that an auxiliary elastic body (18) is interposed between the elastic disk body (16) and the polishing sheet (17).

24. The polishing buff wheel of claim 23, characterized in that the elastic force of the auxiliary elastic body (18) is made smaller than that of the elastic disk body (16).

25. The polishing buff wheel of claim 22, characterized in that the auxiliary elastic body (18) is secured to the polishing sheet (17) and the auxiliary elastic body (18) is detachably arranged on the elastic disk body (16).

26. A polishing buff wheel characterized in that a boss member (15) is detachably arranged in the axial center portion of an elastic disk body (16) and one side surface of the disk body (16) is made project beyond the boss member (15) and the projecting one side surface of the disk body (16) is provided with the detachable polishing sheet (17).

27. The polishing buff wheel of claim 26, characterized in that an auxiliary elastic body (18) is interposed between the elastic disk body (16) and the polishing sheet (17).

28. The polishing buff wheel of claim 27, characterized in that the elastic force of the auxiliary elastic body (18) is made smaller than that of the elastic disk body (16).

29. The polishing buff wheel of claim 26 characterized in that the auxiliary elastic body (18) is secured to the polishing sheet (17) and the auxiliary elastic body (18) is detachably arranged on the elastic disk body (16).

30. The polishing buff wheel of claim 24, characterized in that the auxiliary elastic body (18) is secured to the polishing sheet (17) and the auxiliary elastic body (18) is detachably arranged on the elastic disk body (16).

31. The polishing buff wheel of claim 28, characterized in that the auxiliary elastic body (18) is secured to the polishing sheet (17) and the auxiliary elastic body (18) is detachably arranged on the elastic disk body (16).

* * * * *